US006705378B1

(12) United States Patent
Smidt

(10) Patent No.: US 6,705,378 B1
(45) Date of Patent: Mar. 16, 2004

(54) RETRACTABLE GARAGE SCREEN

(76) Inventor: Brian P. Smidt, 1218 N. Ash Ave., Broken Arrow, OK (US) 74012

( * ) Notice: Subject to any disclaimer, the term of this patent is extended or adjusted under 35 U.S.C. 154(b) by 25 days.

(21) Appl. No.: 10/244,582

(22) Filed: Sep. 16, 2002

(51) Int. Cl.[7] ..... E06B 9/08

(52) U.S. Cl. ..... 160/120; 160/98; 160/113; 160/DIG. 18

(58) Field of Search ..... 160/113, 120, 160/121.1, 321, DIG. 18, 191, 192, 133, 98

(56) References Cited

U.S. PATENT DOCUMENTS 3,640,332 A * 2/1972 Luby et al. ..... 160/133
4,137,683 A * 2/1979 Pfeiffer ..... 160/DIG. 18 X
4,424,852 A * 1/1984 Hopper ..... 160/321 X
4,657,059 A * 4/1987 Clauss ..... 160/120
4,673,019 A * 6/1987 Silverthorne et al. 160/290.1 X
4,738,296 A * 4/1988 Hatch ..... 160/133
4,846,241 A * 7/1989 Chomka et al. ..... 160/23.1
5,163,492 A * 11/1992 Remington et al. ..... 160/321 X
5,275,223 A * 1/1994 Magro et al. ..... 160/316 X
5,427,169 A * 6/1995 Saulters ..... 160/DIG. 18 X
5,899,254 A * 5/1999 Cook ..... 160/321
5,988,256 A * 11/1999 Winters ..... 160/DIG. 18 X
6,053,235 A * 4/2000 Ruffner ..... 160/113 X
6,070,640 A * 6/2000 Miyagawa et al. ..... 160/121.1

* cited by examiner

*Primary Examiner*—David Purol
(74) *Attorney, Agent, or Firm*—Molly D. McKay

(57) ABSTRACT

A retractable garage screen that can be installed inside a garage at a garage door opening where an existing overhead garage door is already installed without interfering with the operation of the existing garage door. The present invention installs just above an existing overhead garage door and employs some of the same hardware used in installing an overhead garage door. The screen door of the present invention is provided with a center zipper that allows the garage screen door to be retracted around the existing sectional door mechanism and also serves as a door for passing through the screen door when the screen door is in use.

17 Claims, 7 Drawing Sheets

RETRACTABLE GARAGE SCREEN

BACKGROUND OF THE INVENTION

1. Field of the Invention

The present invention relates to a retractable garage screen that can be installed inside a garage at a garage door opening where an existing overhead garage door is already installed without interfering with the operation of the existing garage door. The present invention installs just above an existing overhead garage door and employs some of the same hardware used in installing an overhead garage door. The screen door of the present invention is provided with a center zipper that allows the garage screen door to be retracted around the existing sectional door mechanism and also serves as a door for passing through the screen door when the screen door is in use.

2. Description of the Related Art

Various types of screens have been proposed for installation at a garage door opening. Some of these screens attach directly to the garage door opening via hook and loop closures or other similar means. These screens have the disadvantage that they must be installed on the outside of the garage door opening so as not to interfere with the operation of an overhead garage door that is installed in the opening. Another disadvantage of these types of screens is that they have to be removed in order for a vehicle to be admitted or removed from the garage. And once they are removed, they must be stored somewhere.

To address the removal and storage problems, other screens have been designed to be retractable and are mounted on the outside of the garage opening so that they do not interfere with the operation of the overhead garage door that is mounted on the inside of the opening. These screens are visible from the outside of the building and undesirable esthetically.

Other screens that have been proposed are integrated into the same track system as the existing overhead garage door. These screens are difficult and expensive to install since the existing overhead garage door and its tracks must be removed and replaced in order to install these types of screens.

The present invention addresses all of these problems by providing an inside mounted retractable screen that quickly installs above an existing overhead garage door without modifying or interfering with the existing overhead garage door. The invention is a retractable screen that automatically rolls up above the existing overhead garage door when the screen is not in use. The invention is provided with a vertical center zipper that allows the garage screen to be retracted around the existing sectional door mechanism when the screen is not in use and also serves as a door for passing through the screen when the screen is in use.

Further, the present invention can be installed at a low cost because it employs many of the same standard parts employed to install an overhead garage door. Because installers already have many of the standard parts needed to install the present screen, the screen kit can be shipped to installers without those standard parts, thus greatly reducing the size of the shipping package and the shipping costs.

SUMMARY OF THE INVENTION

The present invention is a retractable garage screen that installs inside a garage at a garage door opening where an existing overhead garage door is already installed. The present invention installs just above an existing overhead garage door without interfering with the operation of the existing garage door. The screen is installed employing some of the same hardware used in installing an overhead garage door and employing some new items. The screen door of the present invention is provided with a center zipper that allows the garage screen door to be retracted around the existing sectional door mechanism and also serves as a door through which people can pass when the screen is in use.

The screen door attaches to a pair of rotatable drums via hook and loop fasteners. Each drum is preferably constructed of a length of 3 inch ID schedule 40 PVC pipe. The drums are provided on a tube so that the drums rotate in conjunction with the tube. The tube is rotatably fastened to either the wall of the garage or to the ceiling of the garage adjacent the garage door opening and just above the existing overhead garage door mechanism. The tube fastens to either the wall or ceiling via two end bearing plates and via a center bearing plate. The tube extends beyond a first end bearing plate and is provided with a pulley attached to the tube so that the tube rotates in conjunction with rotation of the pulley. A chain is provided around the pulley as a means of rotating the pulley. If the pulley is manually operated by a chain, a chain locking bracket is attached to the inside of the wall of the garage to removably receive the chain in order to prevent the pulley and tube from rotating. Optionally, although not illustrated, the pulley can be operated via an electric motor instead of by manually pulling the chain.

Each of the drums is attached on one end of the drum to the tube via a first end drum hub. These end drum hubs are each provided with threaded bolt openings extending therethrough. Bolts threadably engage these threaded bolt openings and tighten against the tube as a means of securing the end drum hubs to the tube. The bolt openings are located approximately at right angles to each other so that when the bolts tighten in the threaded bolt openings, the bolts engage the tube and thereby secure the end drum hubs to the tube. The end drum hubs are, in turn, secured to the drums via pop rivets that extend through the drums and engage the end drum hubs.

One of the drums is provided with a second end drum hub on its opposite end that attaches that end of the drum to the tube in the same manner as described previously for the first end of the drums.

The other drum is provided with a specially designed center end cone and spring assembly via which that second drum is supported by the spring assembly which is secured to the tube and to the center bearing plate, as will be described more fully hereafter.

The spring assembly consists of the center end cone, a spring tube, a specially designed fastening cone, a spring, and several washers.

The center end cone has an approximately 1 inch diameter bearing on one end of the center end cone and is provided with a flange having bolt openings therethrough on the other end of the center end cone. The flange fastens to the center bearing plate via bolts. A spring opening is provided in the center end cone to allow one end of the spring to be attached to the center end cone.

The spring tube is approximately 36 inches long and preferably constructed of 2 inch ID PVC pipe. One end of the spring tube is provided with an approximately 1 inch diameter bearing that mates race to race with the bearing provided in the center end cone.

The fastening cone has threaded bolt openings extending therethrough to attach the fastening cone to the tube via bolts that engage the threaded bolt openings. The bolts are tightened so that the threaded end of the bolt contacts the tube and thereby secures the fastening cone to the tube. A spring opening is provided in the fastening cone to allow a second end of the spring to be attached to the fastening cone, and via the fastening cone, to the tube.

The spring attaches, as previously described, on one end to the center end cone and on its opposite second end to the fastening cone. Several washers are placed around the abutting bearing of the center end cone and bearing of the spring tube to serve as spacers so that the spring, which encircles the spring tube, will not become entangled between the center end cone and the spring tube and will not interfere with the functioning of the underlying bearings. Approximately four washers are needed for this purpose and they prevent the spring from deforming over time.

The spring of the spring assembly is prestretched but not preloaded when the spring assembly is attached to the tube and the associated drum is placed over the spring assembly. Prestretching the spring of the spring assembly is necessary because the spring will lengthen as it is loaded, i.e. twisted to place a torque on the spring. The spring is not loaded until the spring assembly is inserted inside the drum. Therefore, if the spring is not prestretched, it would cause the spring to bind in its coils and not function properly. Instead, by prestretching the spring, the spring remains within the drum and provides a torque force to rotate the attached tube, drums, and screen door.

The spring tube holds the center end cone and fastening cone apart a specific distance which is normally approximately 2½ to 3 inches longer than the non-stretched spring. The spring manufacturer dictates the specific distance that a particular type of spring should be stretched. The spring is then inserted over the spring tube and the two ends of the spring are fastened to the center end cone and the fastening cone. In order for the ends of the spring to be fastened to the cones, the spring must be stretched.

Once the ends of the spring are fastened to the cones, via the spring openings provided in the cones, the spring is prevented from returning to its pre-stretched length by the spring tube which holds the two cones apart. The spring tube engages the center end cone via their respective bearings and engages the fastening cone by a first shoulder provided on the fastening cone for this specific purpose. A second shoulder is provided on the fastening cone to prevent that end of the spring from being pushed off of the fastening cone. Likewise, the flange on the center end cone prevents the spring opposite end of the spring from being pushed off of the center end cone.

Opposite ends of the tube are rotatably supported to the inside wall or ceiling of the garage by end bearing plates having bearings therein through which the tube extends. One of the ends of the tube is attached to a pulley that is provided with a pulley chain or other suitable means for rotating the pulley.

Once the spring assembly has been attached to the tube and to the center end cone and the tube has been secured via the end bearing plates to the garage wall or ceiling, the spring is then ready to be loaded. This is done by turning the tube via the attached pulley and pulley chain. In order to properly load the spring, the drum should be rotated by the installer approximately ten to fifteen rotations. Once properly loaded, the spring tends to unwind. It is this tendency to unwind that assists the operator in opening the garage screen door. To ensure that the spring does not unwind until desired, the pulley chain is secured to a wall locking bracket provided for this purpose.

After the hardware has been thus installed, the garage screen door is then ready to be attached to the drums. Each screen door is provided with two upper portions of the screen door that are preferably constructed of vinyl or other water repellant material. The upper ends of each of the two upper portions of the screen door are provided with a strip of hook and loop fastening tape which mates with a corresponding strip of hook and loop fastening tape provided on each of the drums to thereby removably secure the screen door to the two drums. Hook and loop fastening tape is preferred as a means of securing the screen door to the drums because it allows the screen door to be removed and replaced easily in the event that the screen door becomes damaged and for ease of installation.

The remaining lower portions of the screen door are constructed of a woven mesh fabric. One fabric that has been shown suitable for this service is the TEXTILENE® woven polyester fabric available from Unitex or from Twitchell Corporation located at 4031 Ross Clark Circle N.W., Dothan, Ala. 36304. The screen door is provided centrally with a vertically oriented zipper that zips to close the screen door and unzips to allow people to pass through the screen door when the screen door is in use. The zipper also allows the lower portion of the screen door to be unzipped so that the lower portion can be separated in the middle to allow it to pass around a garage door opener bracket that is normally installed centered above the garage door opening. The garage door opener bracket attaches to the garage wall and hardware for a garage door opener mounts to the garage door opener bracket. It is important that the screen door be separated vertically in the middle and that the two halves of the screen door be able to pass around the garage door opener bracket because the tube and drum that support the screen door are installed above the garage door opener bracket within the garage. The various portions of the screen door are secured together with web material and the edges of the screen door are finished by sewing the web material to the screen door.

The screen door is provided with a bottom flap to secure the screen door to the garage floor when the screen door is in use. Also, just above the bottom flap, the screen door is provided with a bottom sleeve into which a pipe, tube, or other similar item can be inserted to provide a weight at the bottom of the screen door to further insure that the bottom of the screen door seals to the floor of the garage when the screen door is in use.

Optionally, hook and loop fasteners can be attached on the sides of the screen door and to the inside facing of the garage door opening as a means of removably securing the sides of the screen door to the opening when the screen door is in use.

DETAILED DESCRIPTION OF THE PREFERRED EMBODIMENT INVENTION

Figure 1:
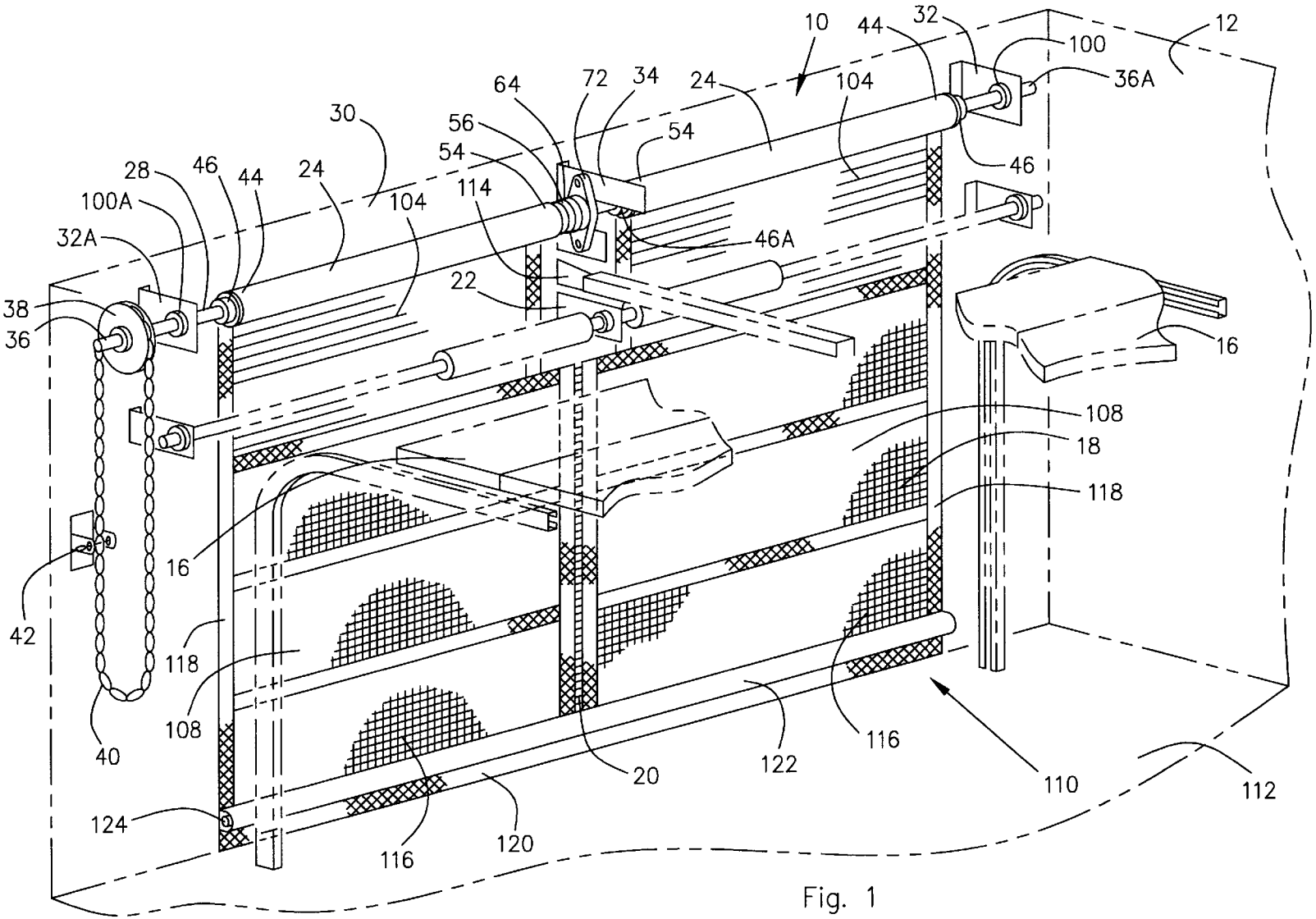
FIG. 1 is a perspective view of a retractable garage screen constructed in accordance with a preferred embodiment of the present invention, shown installed in a garage along with an overhead garage door.
Figure 2:
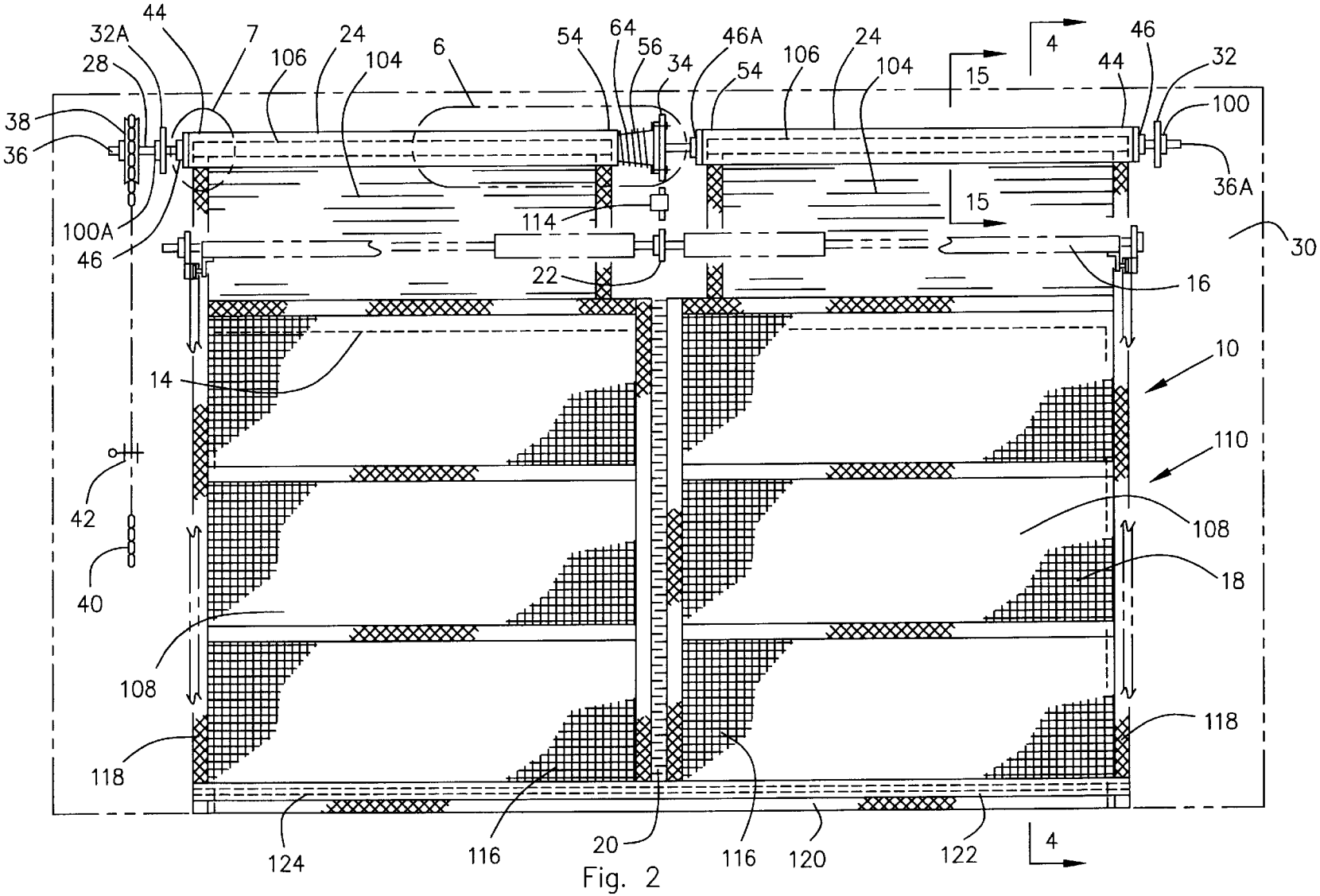
FIG. 2 is a rear view of the retractable garage screen of FIG. 1, shown with the screen in its in use position.
Figure 3:
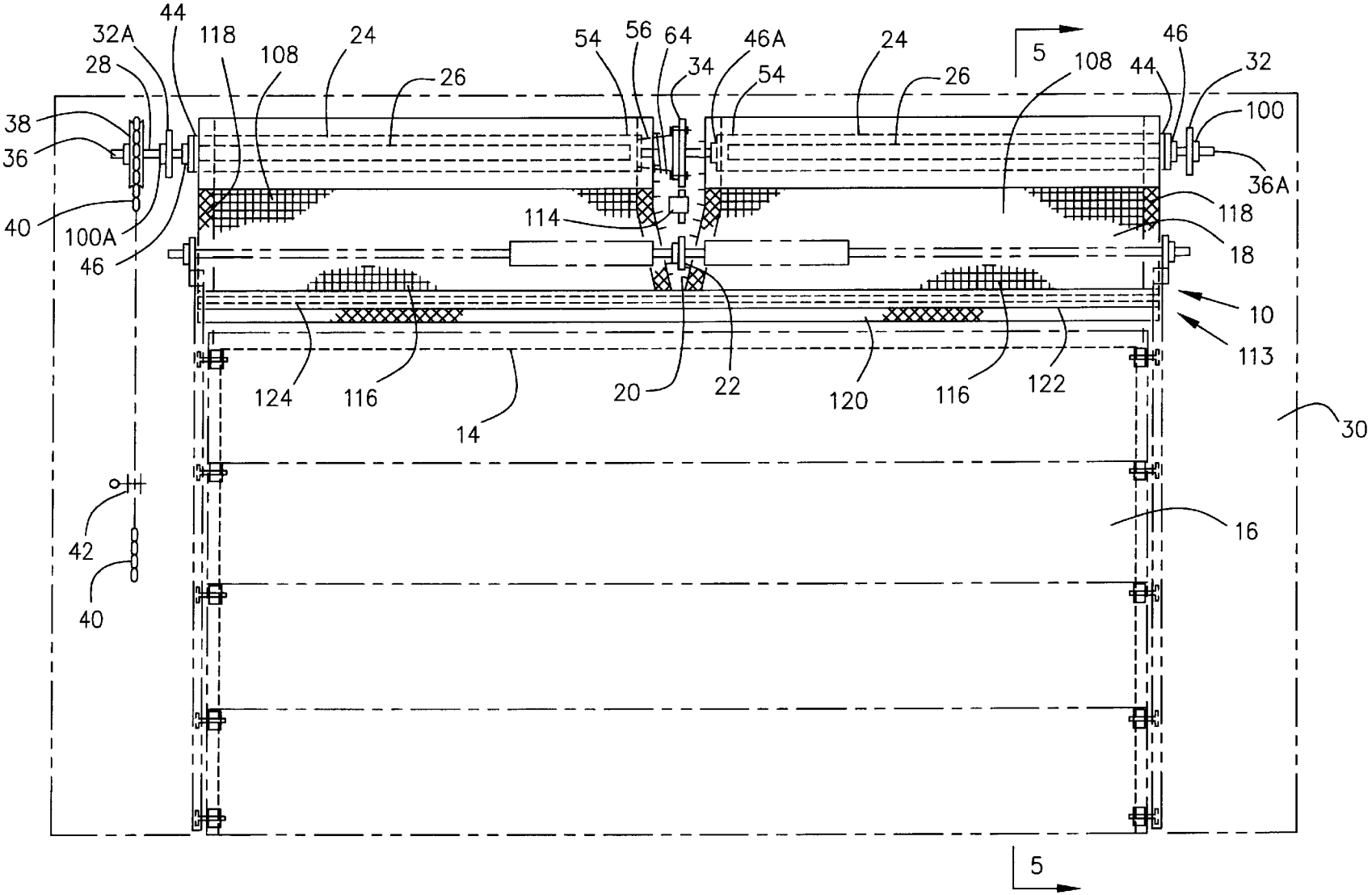
FIG. 3 is a rear view of the retractable garage screen of FIG. 2 shown in its retracted position.

Referring now to the drawings and initially to FIGS. 1, 2 and 3, there is illustrated a retractable garage screen 10 constructed in accordance with a preferred embodiment of the present invention. As illustrated, the retractable garage screen 10 installs inside a garage 12 at a garage door opening 14 where an existing overhead garage door 16 is already installed. The retractable garage screen 10 installs just above an existing overhead garage door 16 without interfering with the operation of the existing garage door 16.

Figure 16:
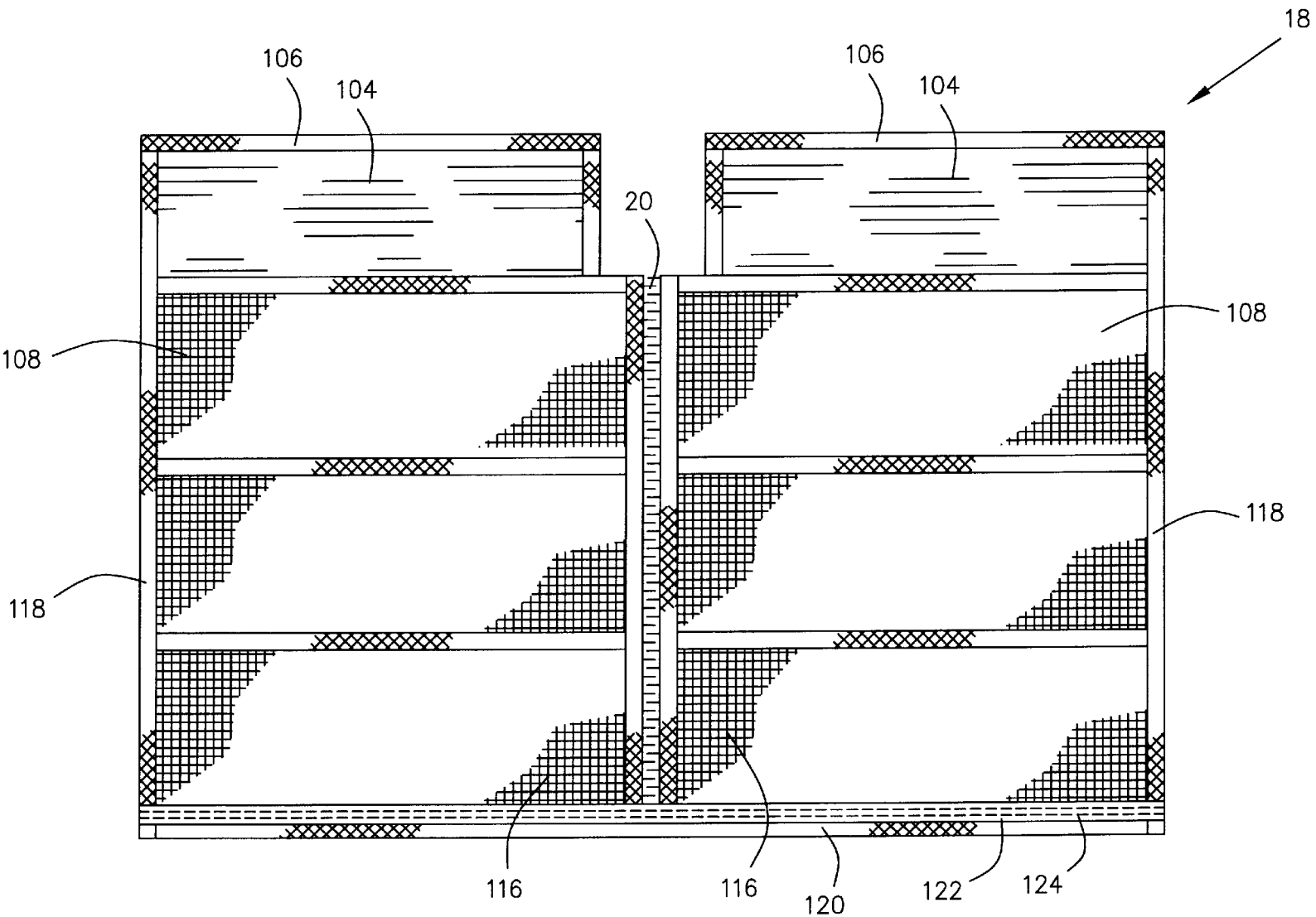
FIG. 16 is a rear view of the screen door illustrated in FIG. 2 shown detached from the rotatable drums.

The retractable garage screen 10 is installed employing some of the same hardware used in installing an overhead garage door 16 and employing some new items. As illustrated in FIG. 16, the screen door 18 of the present invention is provided with a center zipper 20 that allows the screen door 18 to be retracted around the existing sectional door mechanism 22 and also serves as a door through which people can pass when the retractable garage screen 10 is in use.

The screen door 18 attaches to a pair of hollow, rotatable drums 24 via hook and loop fasteners 26. Each drum 24 is preferably constructed of a length of 3 inch ID schedule 40 PVC pipe. The drums 24 are secured to a tube 28 which extends through the drums 24 so that the drums 24 rotate in conjunction with the tube 28. The tube 28 is rotatably fastened to either the wall 30 of the garage 12 or to the ceiling 31 of the garage 12 adjacent the garage door opening 14 and just above the existing overhead garage door mechanism 22. The tube 28 fastens to either the wall 30 or ceiling via two end bearing plates 32 and via a center bearing plate 34. A first end 36 of the tube 28 extends beyond the first end bearing plate 32A and is provided with a pulley 38 attached to the tube 28 so that the tube 28 rotates in conjunction with rotation of the pulley 38. A chain 40 is provided around the pulley 38 as a means of rotating the pulley 38. If the pulley 38 is manually operated by the chain 40, a chain locking bracket 42 is attached to the inside of the wall 30 of the garage 12 to removably receive the chain 40 in order to prevent the pulley 38 and tube 28 from rotating. Optionally, although not illustrated, the pulley 38 can be operated via an electric motor instead of by manually pulling the chain 40.

Each of the drums 24 is attached on a first end 44 of the drum 24 to the tube 28 via a hollow end drum hub 46. The end drum hubs 46 must be hollow because the tube 28 extends through each of the end drum hubs 46. Details of the end hubs 46 are illustrated in FIGS. 7, 8, 9 and 10. These end drum hubs 46 are each provided with threaded bolt openings 48 extending there through. Bolts 50 threadably engage these threaded bolt openings 48 and tighten against the tube 28 as a means of securing the end drum hubs 46 to the tube 28. The bolt openings 48 are located approximately at right angles to each other so that when the bolts 50 tighten in the threaded bolt openings 48, the bolts 50 engage the tube 28 and thereby secure the end drum hubs 46 to the tube 28. The end drum hubs 46 are, in turn, secured to the drums 24 via pop rivets 52 that extend through the drums 24 and engage the end drum hubs 46.

One of the drums 24 is provided with a second end drum hub 46A on its opposite second end 54 that attaches that end 54 of the drum 24 to the tube 28 in the same manner as described previously for the first end 44 of the drums 24. The second end drum hub 46A is identical to the end drum hubs 46 previously described.

The other drum 24 is provided with a specially designed, hollow, center end cone 56 as a part of a spring assembly 58 via which the second end 54 of that second drum 24 is loosely supported. The spring assembly 58 is secured to the tube 28 and to the center bearing plate 34 with the second drum 24 resting on the spring assembly 58, as illustrated in FIG. 6 and as will be described more fully hereafter.

The spring assembly 58 consists of the center end cone 56, a hollow spring tube 60, a specially designed hollow fastening cone 62, a spiral spring 64, and several washers and 66.

Figure 6:
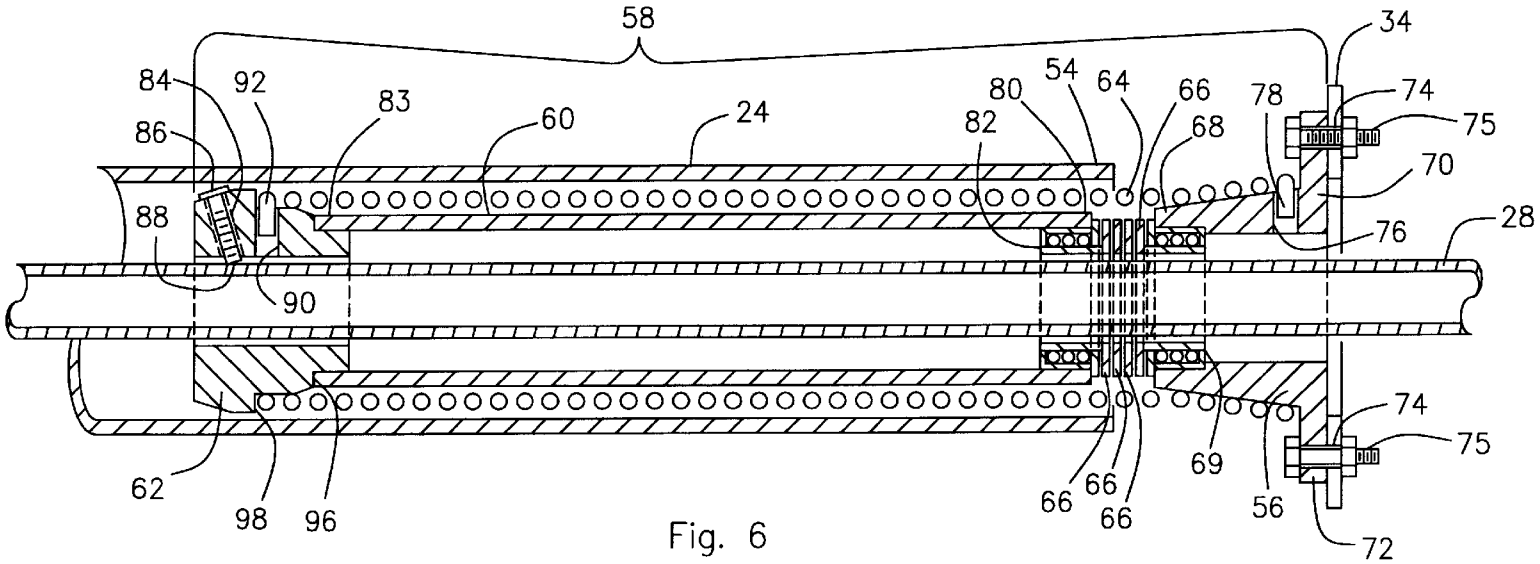
FIG. 6 is a detailed cross sectional view of the circled area associated with numeral 6 in FIG. 2.
Figure 7:
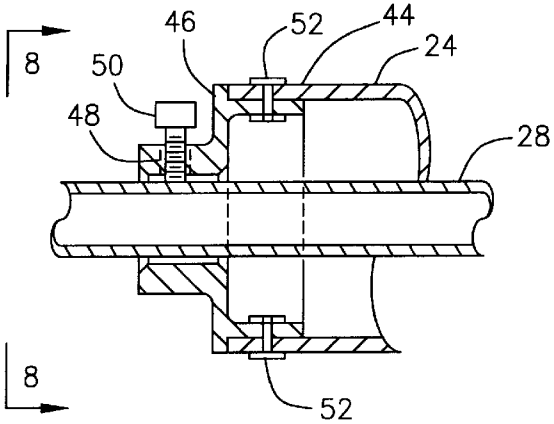
FIG. 7 is a detailed cross sectional view of the circled area associated with numeral 7 in FIG. 2.
Figure 8:
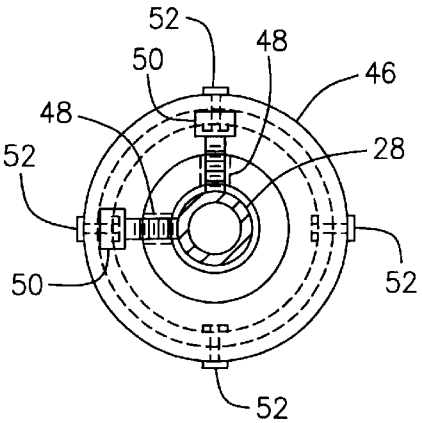
FIG. 8 is a cross sectional view taken along line 8—8 of FIG. 7.
Figure 13:
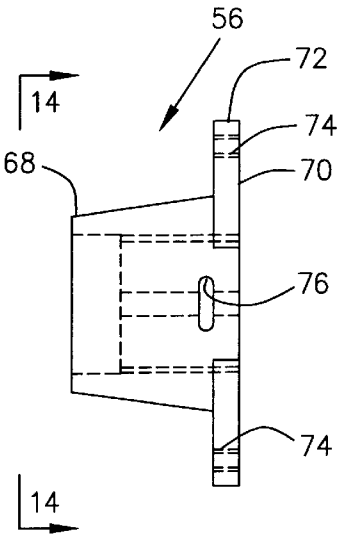
FIG. 13 is a side view of the center end cone illustrated in FIG. 6 shown with its associated bearing removed.
Figure 14:
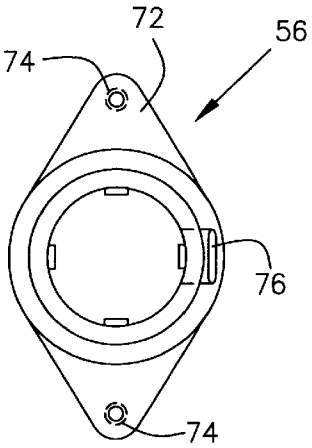
FIG. 14 is an end view of the center end cone taken along line 14—14 of FIG. 13.

As illustrated in FIG. 6, a first end 68 of the center end cone 56 has an approximately 1 inch diameter bearing 69 attached to the end 68 and an opposite second end 70 that is provided with a flange 72. As also illustrated in FIGS. 13 and 14, the flange 72 has bolt openings 74 extending there through. The flange 72 fastens to the center bearing plate 34 via bolts 75 which insert through the bolt openings 74 and engage the center bearing plate 34. A spring opening 76 is provided in the center end cone 56 into which one end 78 of the spring 64 inserts to attach the spring 64 to the center end cone 56.

Referring again to FIG. 6, the spring tube 60 is approximately thirty six (36) inches long and preferably constructed of 2 inch ID PVC pipe. One end 80 of the spring tube 60 is provided with an approximately 1 inch diameter bearing 82 that mates race to race with the bearing 69 provided in the first end 68 of the center end cone 56 and an opposite second end 83 of the spring tube 60 attaches to the fastening cone 62 via friction.

Figure 11:
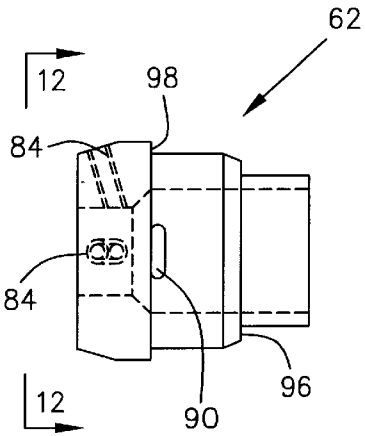
FIG. 11 is a side view of the fastening cone illustrated in FIG. 6.
Figure 10:
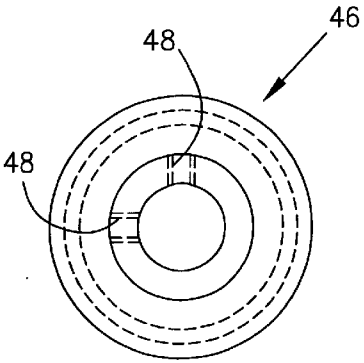
FIG. 10 is an end view of the end drum hub taken along line 10—10 of FIG. 9.
Figure 12:
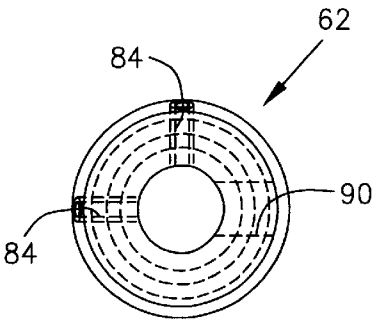
FIG. 12 is an end view of the fastening cone taken along line 12—12 of FIG. 11.

As also illustrated in FIGS. 11 and 12, the fastening cone 62 has threaded bolt openings 84 extending there through to attach the fastening cone 62 to the tube 28 via bolts 86 that engage the threaded bolt openings 84. Each of the bolts 86 is tightened so that a threaded end 88 of the bolt 86 contacts the tube 28 and thereby secures the fastening cone 62 to the tube 28. A spring opening 90 is provided in the fastening cone 62 to allow a second end 92 of the spring 64 to be attached to the fastening cone 62, and via the fastening cone 62, to the tube 28.

The spring 64 attaches, as previously described, on one end 78 to the center end cone 56 and on its opposite second end 92 to the fastening cone 62. Several washers 66 are placed around the abutting bearings 69 and 82 of the center end cone 56 and the spring tube 60 to serve as spacers so that the spring 64, which encircles the spring tube 60, will not become entangled between the center end cone 56 and the spring tube 60 and will not interfere with the functioning of the underlying bearings 69 and 82. Approximately four washers 66 are needed for this purpose and they prevent the spring 64 from deforming over time.

The spring 64 of the spring assembly 58 is pre-stretched but not preloaded when the spring assembly 58 is attached to the tube 28 and the associated drum 24 is placed over the spring assembly 58. Pre-stretching the spring 64 of the spring assembly 58 is necessary because the spring 64 will lengthen as it is loaded, i.e. twisted to place a torque on the spring 64. The spring 64 is not loaded until the spring assembly 58 is inserted inside the drum 24. Therefore, if the spring 64 is not pre-stretched, it would caus the spring to bind in its coils and not function properly. Instead, by pre-stretching the spring 64, the spring 64 functions properly to provide a torque force to rotate the attached tube 28, drums 24, and screen door 18.

The spring tube 60 holds the center end cone 56 and fastening cone 62 apart a specific distance which is normally approximately 2½ to 3 inches longer than the length of the spring 64 prior to the spring 64 being stretched. The spring manufacturer dictates the specific distance that a particular type of spring 64 should be stretched. The spring 64 is then inserted over the spring tube 60 and the two ends 78 and 92 of the spring 64 are fastened respectively to the center end cone 56 and the fastening cone 62. In order for the ends 78 and 92 of the spring 64 to be fastened to the cones 56 and 62, the spring 64 must be stretched.

Once the ends 78 and 92 of the spring 64 are fastened to the cones 56 and 62 via the spring openings 76 and 90 provided respectively in the cones 56 and 62, the spring 64 is prevented from returning to its pre-stretched length by the spring tube 60 which holds the two cones 56 and 62 apart. The first end 80 of the spring tube 60 engages the center end cone 56 via their respective bearings 69 and 82 and a second end 83 of the spring tube 60 engages an end of the fastening cone 62 so that the second end 83 abuts a first shoulder 96 provided on the fastening cone 62 for this specific purpose. A second shoulder 98 that is larger in diameter than the first shoulder 96 is provided on the fastening cone 62 adjacent to the first shoulder 96. The second end 92 of the spring 64 rests against the second shoulder 98, and the spring 64 is stretched between the two cones 62 and 56.

Opposite ends 36 and 36A of the tube are rotatably supported to the inside wall 30 or ceiling of the garage 12 by a pair of end bearing plates 32 and 32A having bearings 100 and 100A therein through which the tube 28 extends. The first end 36 of the tube 28 is attached to the pulley 38 that is provided with the pulley chain 40 or other suitable means (not illustrated) such as for example a motor, for rotating the pulley 38.

Once the spring assembly 58 has been attached to the tube 28 and to the center end cone 56, the tube 28 has been secured via the end bearing plates 32 and 32A to the garage wall 30 or ceiling, and the drums 24 have been secured to the tube 28, the spring 64 is then ready to be loaded. This is done by turning the tube 28 via the attached pulley 38 and pulley chain 40. In order to properly load the spring 64, the chain 40 should be pulled by the user or installer casusing the drum to rotate approximately 10 to 15 revolutions. Once properly loaded, the spring 64 tends to want to unwind. It is this tendency to unwind that assists the operator in opening the screen door 18. To ensure that the spring 64 does not unwind until desired, the pulley chain 40 is secured to the wall locking bracket 42 provided attached to the wall 30 of the garage 12 for this purpose.

Figure 15:
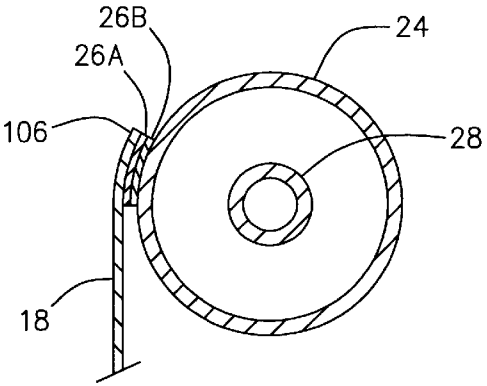
FIG. 15 is a cross sectional view taken along line 15—15 of FIG. 2.
Figure 9:
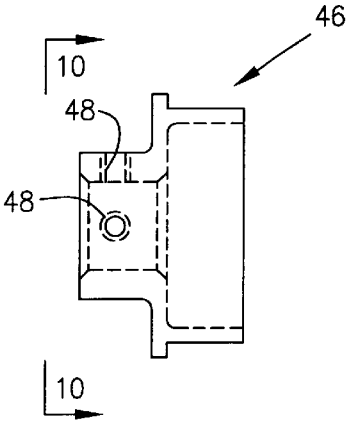
FIG. 9 is a side view of the end drum hub illustrated in FIG. 7.

After the hardware has been thus installed, the screen door 18 is then ready to be attached to the drums 24. Each screen door 18 is provided with two upper portions 104 of the screen door 18 that are preferably constructed of vinyl or other water repellant material. As illustrated in FIG. 15, upper ends 106 of each of the two upper portions 104 of the screen door 18 are provided with a strip of hook and loop fastening tape 26A which mates with a corresponding strip of hook and loop fastening tape 26B provided on each of the drums 24 to thereby removably secure the screen door 18 to the two drums 24. Hook and loop fastening tape 26 comprised of the two mating portions 26A and 26B is preferred as a means of securing the screen door 18 to the drums 24 because it allows the screen door 18 to be removed and replaced easily in the event that the screen door 18 becomes damaged.

Figure 5:
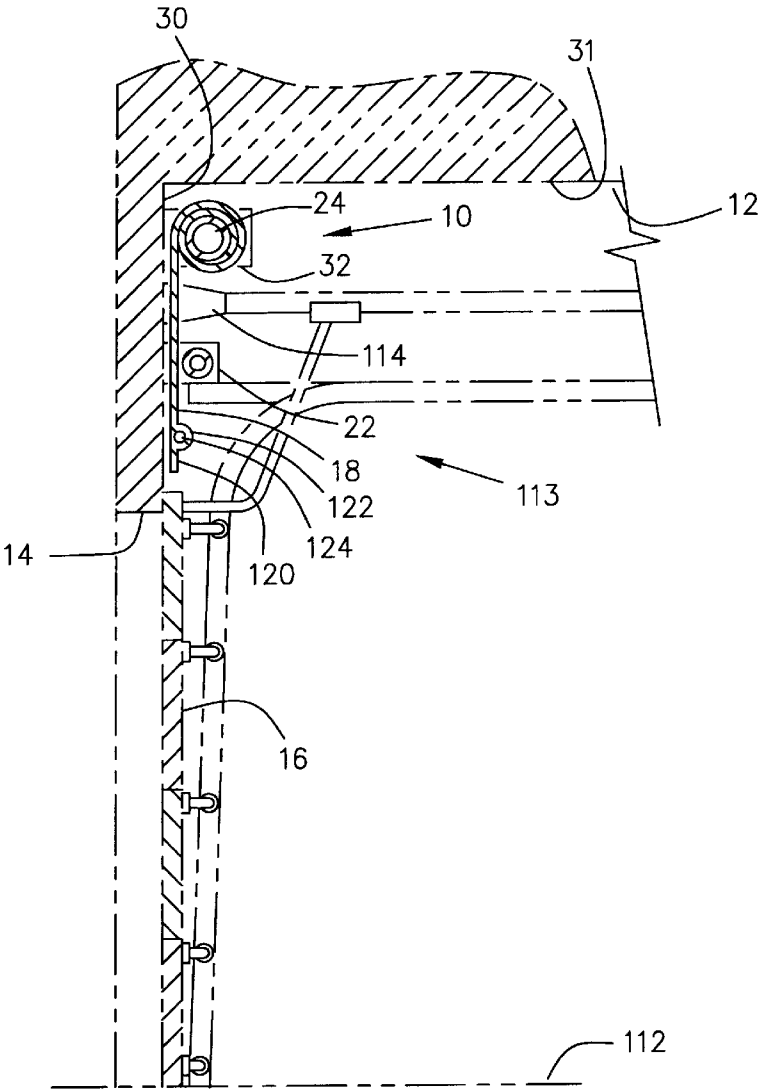
FIG. 5 is a cross sectional view taken along line 5—5 of FIG. 3.
Figure 4:
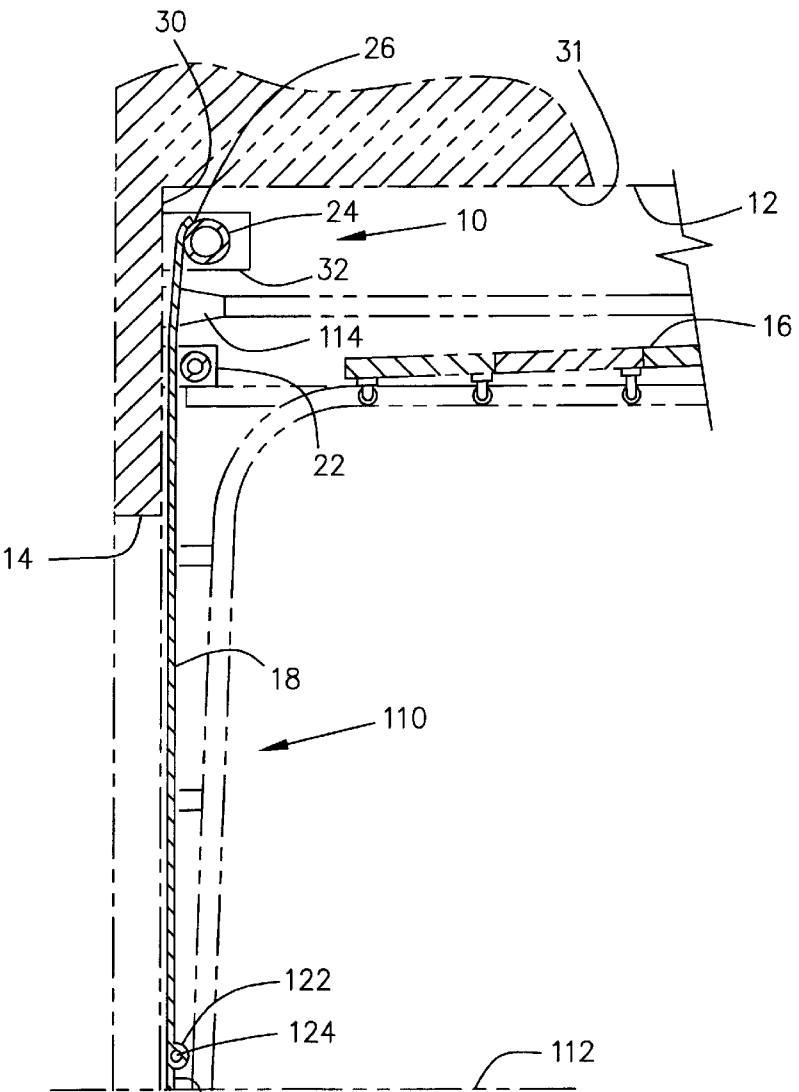
FIG. 4 is a cross sectional view taken along line 4—4 of FIG. 2.

The remaining two lower portions 108 of the screen door 18 are constructed of a woven mesh fabric. One fabric that has been shown suitable for this service is the TEXTILENE® woven polyester fabric available from Unitex or from various suppliers. The lower portions 108 of the screen door 18 are separated by the zipper 20 that is centrally located and vertically oriented. The zipper 20 zips to close the two lower portions 108 and unzips to allow people to pass through the screen door 18 when the screen door 18 is in use. The in use position 110 of the retractable garage screen 10 is illustrated in FIGS. 1, 2 and 4 where the screen door 18 is extended to the floor 112 of the garage 12. The zipper 20 also allows the lower portions 108 of the screen door 18 to be unzipped so that the lower portions 108 can be moved to its retracted position 113 when the screen door 18 is not in use, as illustrated in FIGS. 3 and 5. The zipper 20 unzips to separate the lower portions in the middle, thereby allowing the lower portions 108 of the screen door 18 to pass around a sectional door mechanism 22 and a garage door opener bracket 114 that are normally installed centered above the garage door opening 14. The sectional door mechanism 22 and the garage door opener bracket 114 each attaches to the garage wall 30. Hardware for a garage door opener mounts to the garage door opener bracket 114. It is important that the lower portions 108 of the screen door 18 be separated vertically in the middle and that the two halves of the screen door 18 be able to pass around the sectional door mechanism 22 and the garage door opener bracket 114 because the tube 28 and drums 24 that support the screen door 18 are installed above both the sectional door mechanism 22 and the garage door opener bracket 114 within the garage 12. The various portions 106 and 108 of the screen door 18 are secured together with web material 116 and the side edges 118 of the screen door 18 are also finished by sewing web material 116 to the side edges 118.

The screen door 18 is provided with a bottom flap 120 to seal the screen door 18 to the garage floor 112 when the screen door 18 is in use. Also, just above the bottom flap 120, the screen door 18 is provided with a bottom sleeve 122 into which a pipe, tube, or other similar item 124 can be inserted to provide weight at the bottom flap 120 to further insure that the screen door 18 seals against the floor 112 of the garage 12 when the retractable garage screen 10 is in its in use position 110.

Optionally, although not illustrated, additional hook and loop fasteners can be attached on the side edges 118 of the screen door 18 and to the inside facing of the garage door opening 14 as a means of removably securing the side edges 118 of the screen door 18 to the opening 14 when the retractable garage screen 10 is in its in use position 110.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A retractable garage screen used in conjunction with a garage comprising:

at least one drum rotatably mounted to the interior of a garage adjacent a garage door opening and above existing garage door and garage door opener hardware, a screen attached to said drum so that said screen covers the garage door opening when the screen is in use and so that the screen is rolled onto the drum when the screen is retracted for storage, and a top opening zipper provided in said screen vertically so that said zipper is approximately in the middle of the screen and extends the entire length of the screen and so that the zipper can be unzipped so the zipper opens at the ton of the screen to allow the screen to be split in half so that it can be retracted around existing garage door and garage door opener hardware and onto the drum for storage.

2. A retractable garage screen used in conjunction with a garage according to claim 1 further comprising:

two drums secured to a tube and said tube rotatably mounted to the interior of the garage.

3. A retractable garage screen used in conjunction with a garage according to claim 2 wherein a torque is applied to said drums and said tube so that they tend to rotate to retract the attached screen.

4. A retractable garage screen used in conjunction with a garage according to claim 3 where said screen is constructed of a mesh fabric so that air can pass through the screen.

5. A retractable garage screen used in conjunction with a garage according to claim 3 further comprising:

means to lock the drums and tube from rotating when the screen is in use.

6. A retractable garage screen used in conjunction with a garage according to claim 5 wherein means to lock the drums and tube from rotating when the screen is in use further comprises:

a pulley attached to said tube at one end of the tube so that the tube and the attached drums rotate in unison with the pulley, a chain engaging said pulley so that the pulley turns in unison with the movement of the chain, and a locking bracket attached to the interior of the garage adjacent the garage door opening for removably locking the chain so that it does not move when secured to the locking bracket.

7. A retractable garage screen used in conjunction with a garage according to claim 3 further comprising:

a bottom sleeve provided in the bottom of said screen for receiving a cylindrical object in order to provide weight at the bottom of the screen, and a flap provided on the bottom of the sleeve for sealing the screen to a floor of the garage.

8. A retractable garage screen used in conjunction with a garage according to claim 3 wherein a top portion of the screen is constructed of water repellant material.

9. A retractable garage screen for use with a garage equipped with sectional garage door comprising:

a pair of drums attached to a tube, attachment plates for rotatably mounting said tube to the interior of a garage adjacent a garage door opening and above existing garage door and garage door opener hardware, a screen attached to said drums so that said screen covers the garage door opening when the screen is in use and so that the screen is rolled onto the drum when the screen is retracted for storage, and a top opening zipper provided in said screen vertically so that said zipper is approximately in the middle of the screen and extends the entire length of the screen and so that the zipper can be unzipped so the zipper opens at the ton of the screen to allow the screen to be split in half vertically so that it can be retracted around existing garage door and garage door opener hardware and onto the drum for storage.

10. A retractable garage screen according to claim 9 further comprising:

means for applying a torque to said drums and said tube so that they tend to rotate to retract the attached screen.

11. A retractable garage screen according to claim 10 wherein the means for applying a torque to said drums and said tube is a pre-stretched spring assembly.

12. A retractable garage screen according to claim 10 wherein the pre-stretched spring assembly comprises:

a spiral spring, one end of the spring attached to said rotatable tube and an opposite end of the spring attached to one of said stationary attachment plates so that the spring applies torque when the spring is first loaded by rotating the tube.

13. A retractable garage screen for use with a garage equipped with a sectional garage door comprising:

a pair of drums attached to a tube, attachment plates for rotatable mounting said tube to the interior of a garage adjacent a garage door opening and above existing garage door and garage door opener hardware, a screen attached to said drums so that said screen covers the garage door opening when the screen is in use and so that the screen is rolled onto the drum when the screen is retracted for storage, a zipper provided in said screen vertically so that said zipper is approximately in the middle of the screen and extends the entire length of the screen and so that the zipper can be unzipped to allow people to pass through the screen when the screen is in use and to allow the screen to be split in half vertically so that it can be retracted around existing garage door and garage door opener hardware and onto the drum for storage, means for applying a torque to said drums and said tube so that they tend to rotate to retract the attached screen, a spiral spring, one end of the spring attached to said rotatable tube and an opposite end of the spring attached to one of said stationary attachment plates so that the spring applies torque when the spring is first loaded by rotating the tube, a fastening cone for fastening one end of the spring to the tube, a center end cone for fastening an opposite end of the spring to one of the attachment plates, one end of a spring tube secured to said fastening cone and an opposite end of the spring tube provided with a bearing that abuts a bearing provided on the center end cone so that the spring tube is sandwiched between the center end cone and the fastening cone and said spring encircles the spring tube, and washers provided around the abutting bearings to prevent the spring from deforming at the bearings.

14. A retractable garage screen according to claim 13 further comprising:

means for locking the drums and tube from rotating when the screen is in use.

15. A retractable garage screen according to claim 14 wherein the means for locking the drums and tube from rotating when the screen is in use further comprises:

a pulley attached to said tube at one end of the tube so that the tube and the attached drums rotate in unison with the pulley, a chain engaging said pulley so that the pulley turns in unison with the movement of the chain, and a locking bracket attachable to the interior of the garage adjacent the garage door opening for removably locking the chain so that it does not move when secured to the locking bracket.

16. A retractable garage screen according to claim 9 wherein a top portion of the screen is constructed of water repellant material and lower portions are constructed of a mesh fabric so that air can pass through the lower portions of the screen.

17. A retractable garage screen according to claim 9 further comprising:

a bottom sleeve provided in the bottom of said screen for receiving a cylindrical object in order to provide weight at the bottom of the screen, and a flap provided on the bottom of the sleeve for sealing the screen to a floor of the garage.

* * * * *